US011259587B2

(12) United States Patent
Baker

(10) Patent No.: US 11,259,587 B2
(45) Date of Patent: Mar. 1, 2022

(54) FORCE DISTRIBUTION HELMET

(71) Applicant: William Baker, Cambridge, NY (US)

(72) Inventor: William Baker, Cambridge, NY (US)

( * ) Notice: Subject to any disclaimer, the term of this patent is extended or adjusted under 35 U.S.C. 154(b) by 0 days.

(21) Appl. No.: 17/214,577

(22) Filed: Mar. 26, 2021

(65) Prior Publication Data

US 2021/0315304 A1 Oct. 14, 2021

Related U.S. Application Data

(60) Provisional application No. 63/000,658, filed on Mar. 27, 2020.

(51) Int. Cl.

| | |
|---|---|
| ***A42B 3/06*** | (2006.01) |
| *A42B 3/04* | (2006.01) |
| *A42B 3/32* | (2006.01) |

(52) U.S. Cl.
CPC ..... *A42B 3/06* (2013.01); *A42B 3/0433* (2013.01); *A42B 3/32* (2013.01)

(58) Field of Classification Search
CPC ..... A42B 3/06; A42B 3/068; A42B 3/0433; A42B 3/32; A42B 3/124
See application file for complete search history.

(56) References Cited

U.S. PATENT DOCUMENTS

| | | | | |
|---|---|---|---|---|
| D814,708 | S * | 4/2018 | Thorpe | D29/122 |
| 10,609,979 | B1 * | 4/2020 | Gallo | A63B 71/10 |
| 2006/0112477 | A1 | 6/2006 | Schneider | |
| 2007/0056081 | A1 | 3/2007 | Aspray | |
| 2015/0047110 | A1 | 2/2015 | Chilson | |
| 2016/0345651 | A1 | 12/2016 | Dvorak | |
| 2019/0000173 | A1 * | 1/2019 | Thorpe | A42B 3/06 |
| 2021/0169168 | A1 * | 6/2021 | Thorpe | A63B 71/10 |

FOREIGN PATENT DOCUMENTS

| | | |
|---|---|---|
| CN | 209931608 U | 1/2020 |
| WO | 9851175 A1 | 11/1998 |

OTHER PUBLICATIONS

PCT: International Search Report and Written Opinion of PCT/US21/24491 (related application); Harry Kim; dated Jul. 12, 2021; 8 pages.

* cited by examiner

*Primary Examiner* — Khaled Annis
(74) *Attorney, Agent, or Firm* — Gregory M. Howison

(57) ABSTRACT

An impact resistance spreading helmet is disclosed. The helmet includes a frontal section configured to interface with the forehead of an individual and extend upward over the cranium; a medial section for extending over a portion of the cranium rearward of the frontal section; an occipital section for extending rearward from the medial section and configured to cover a portion of the neck of the individual; a first compressible structure disposed between the frontal section and the medial section; and a second compressible structure disposed between the medial section and the occipital section. The interface between the frontal section and the first compressible structure is disposed at an angle vertical to a force direction perpendicular to the frontal section above the forehead of the individual.

15 Claims, 21 Drawing Sheets

FORCE DISTRIBUTION HELMET

CROSS-REFERENCE TO RELATED APPLICATIONS

This application claims the benefit of U.S. Provisional Application No. 63/000,658, filed on Mar. 27, 2020, entitled FORCE DISTRIBUTION HELMET, which is incorporated by reference in its entirety.

TECHNICAL FIELD

This invention is related to headwear for protecting an individual's head and, more particularly, to a helmet for distributing impact forces around the cranial region of an individual.

BACKGROUND

Headwear for an individual for the purpose of protecting that individual's head in relationship to impacts received in the course of playing sports, as one example, are required to protect the individual's brain from damage. Many helmets for this purpose incorporate some type of foam or flexible plastic or combination thereof to absorb any impact. The helmets can be used for such force as or striding, hockey, football, etc. However, current helmets still do not completely eliminate or prevent brain injuries.

SUMMARY

The present invention disclosed and claimed herein in one aspect thereof, comprises an impact resistance spreading helmet. The helmet includes a frontal section configured to interface with the forehead of an individual and extend upward over the cranium; a medial section for extending over a portion of the cranium rearward of the frontal section; an occipital section for extending rearward from the medial section and configured to cover a portion of the neck of the individual; a first compressible structure disposed between the frontal section and the medial section; and a second compressible structure disposed between the medial section and the occipital section. The interface between the frontal section and the first compressible structure is disposed at an angle vertical to a force direction perpendicular to the frontal section above the forehead of the individual.

BRIEF DESCRIPTION OF THE DRAWINGS description taken in conjunction with the accompanying Drawings in which.

DETAILED DESCRIPTION

Figure 1:
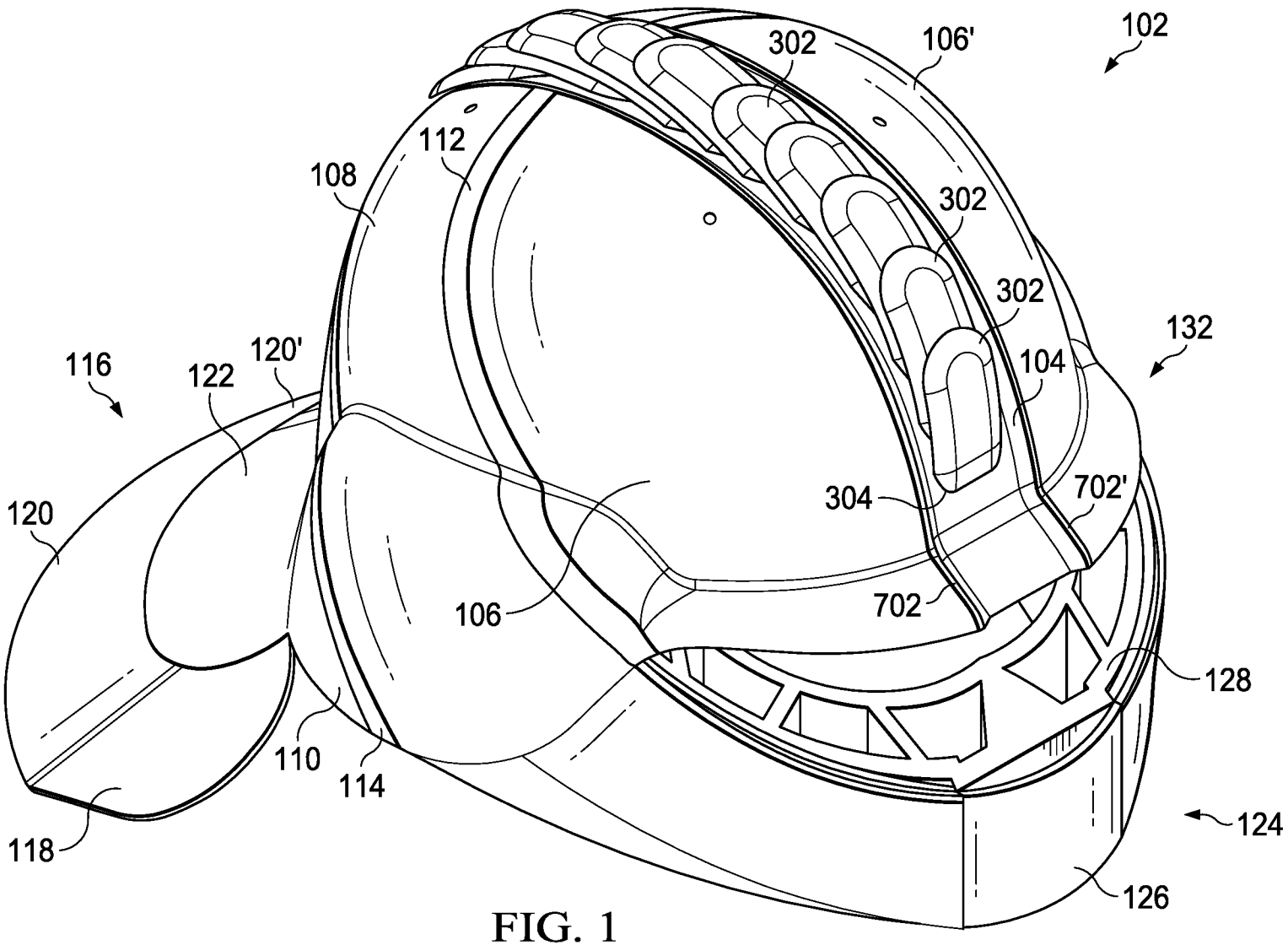
FIG. 1 illustrates a top perspective view of the assembled helmet.

Referring now to the drawings, wherein like reference numbers are used herein to designate like elements throughout, the various views and embodiments of force distribution helmet are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring now to FIG. 1, there is illustrated a top perspective view of a helmet 102 in accordance with the present disclosure. This helmet, as will be described hereinbelow, is operable to distribute any external force due to an impact downward in a direction toward the neck of the individual.

The helmet 102 is divided into multiple segments. For the purposes of this description, the segments are repeated on the left side and the right side, with a sagittal portion 104 running down the middle. The description of the helmet will be with respect to the portions on the right side thereof, with corresponding reference numerals referred to with an "prime" indication. In the assembled helmet 102, the right side will have an frontal panel 106, a parietal panel 108 and then an occipital panel 110. The frontal panel 106 is separated from the parietal panel 108 by a joiner 112 and the parietal panel 108 is separated from the occipital panel 110 by a joiner 114. There is provided a lobster tail portion 116 that extends downward from the back of the occipital portion 110 to cover the neck. This is comprised of, on the right side, a lateral panel 118 and a medial panel 120 that are connected to the occipital panel 110 by a left central panel 122. All of these panels 118-122 are joined together with joiners. The joiners are generally flexible rubber-like strips that, in cross-section, would have an "H" cross-section and have different widths. They are a compressible material that is flexible.

A chin portion 124 is formed as an integral part of the occipital panel 108. It extends down to the lower front portion of the helmet one of two wherein the right side portion of the chin joins with the left side via a joiner 126, which is also a flexible material. An inner foam shell 128 is provided that is a foam honeycombed material this will be described in more detail hereinbelow. A brow portion 132 is provided that is an integral portion of the frontal panels 106 and 106' and also of the sagittal portion 104.

Figure 2:
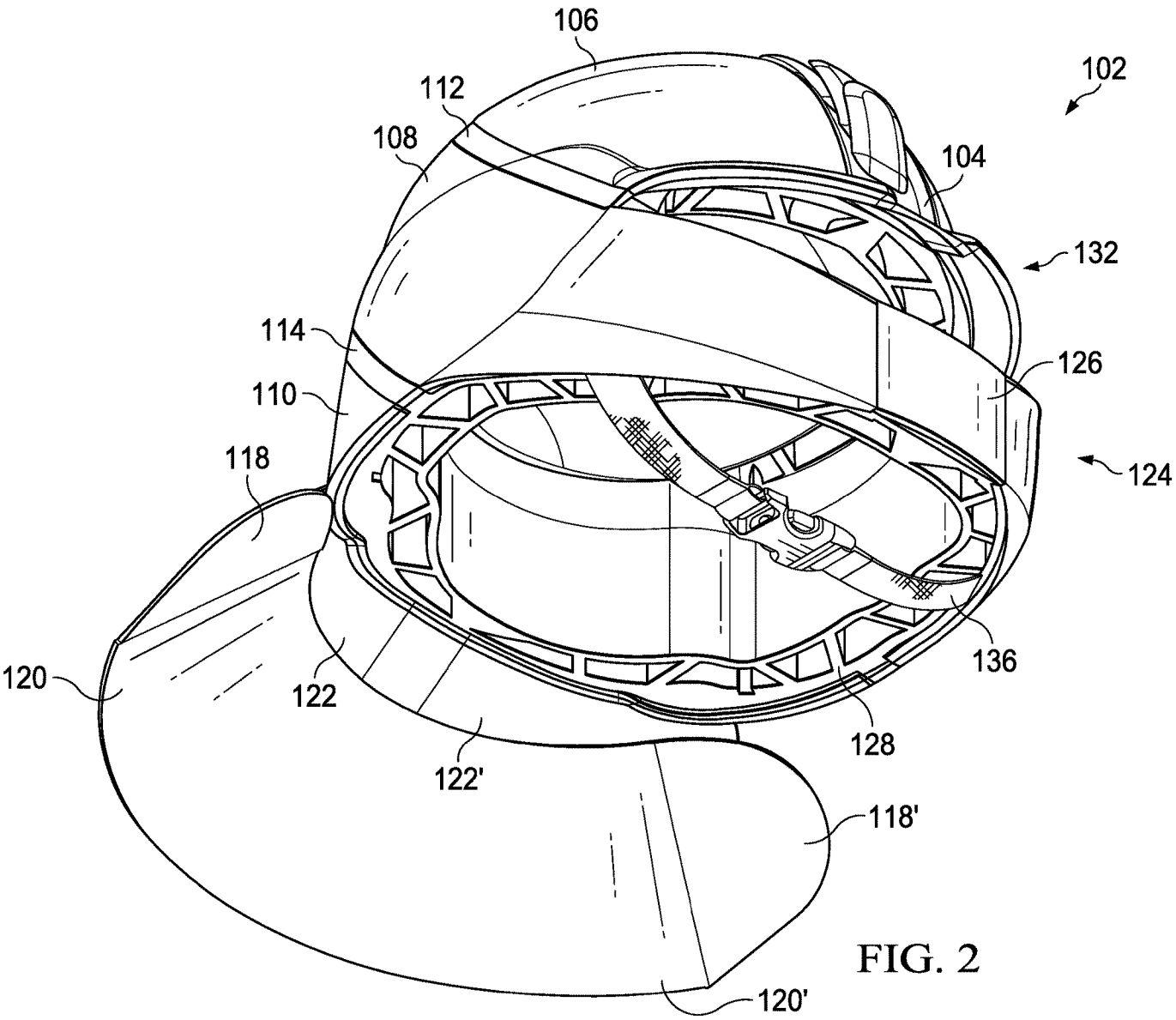
FIG. 2 illustrates a bottom perspective view of the assembled helmet.

FIG. 2 illustrates a bottom perspective view of the helmet 102 illustrating a chin strap 136.

Figure 3:
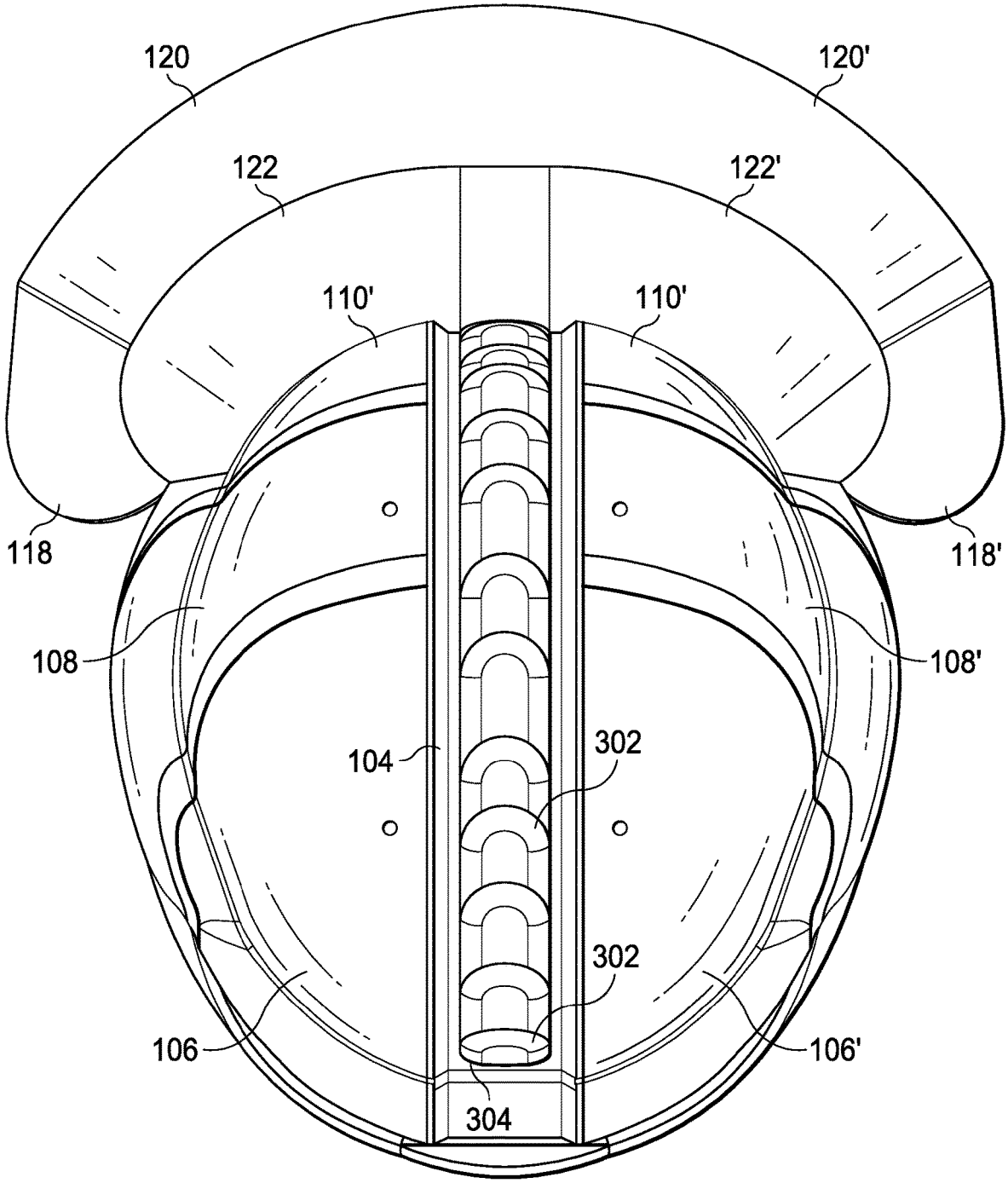
FIG. 3 illustrates a top view of the assembled helmet.

FIG. 3 illustrates a top view of the helmet 102. The sagittal portion 104 is comprised of the plurality of flat plates 302 that are connected at the sagittal plate at an end 304 and there are flexible and overlapping from the front to the back.

Figure 4:
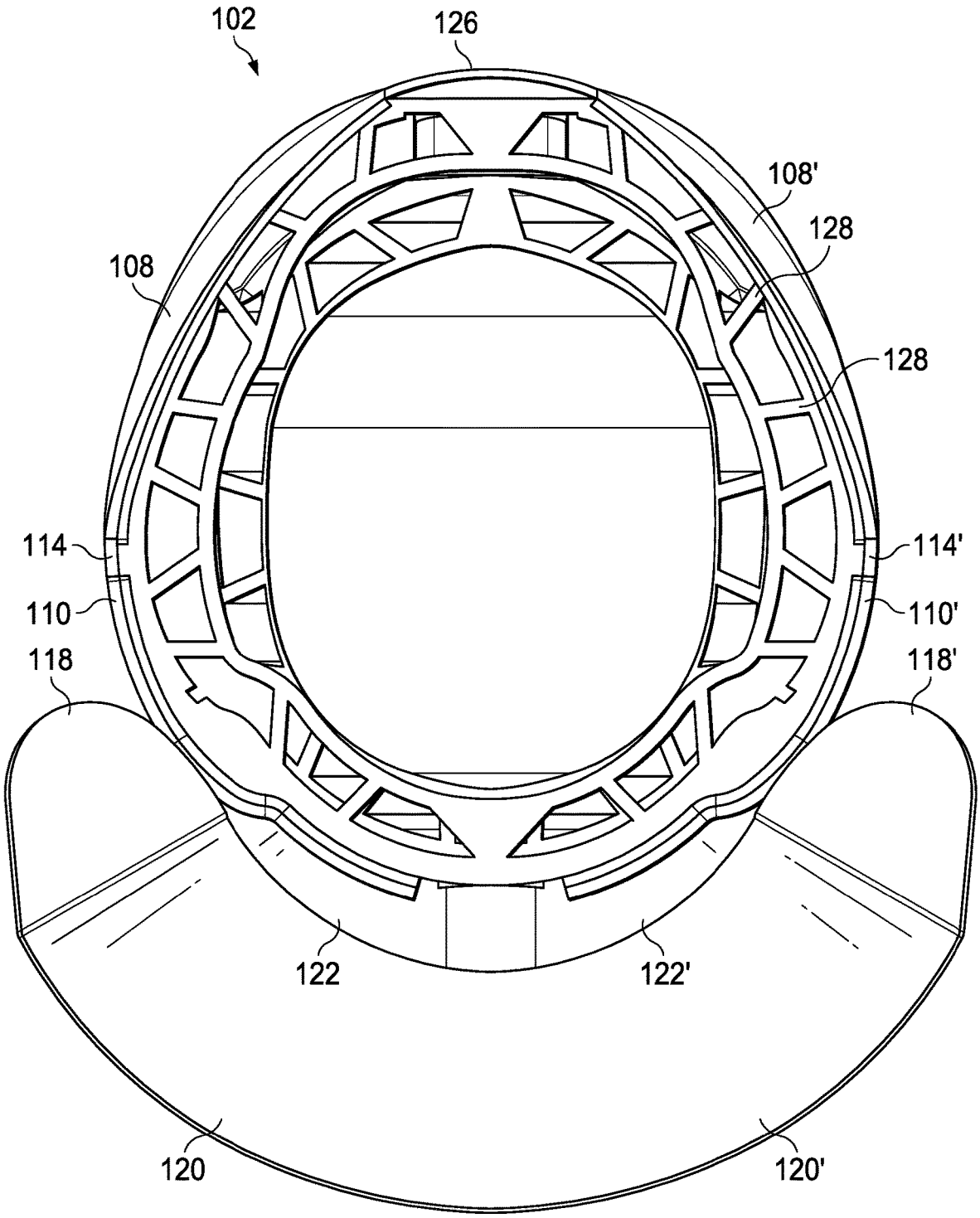
FIG. 4 illustrates a bottom view of the assembled helmet.

FIG. 4 illustrates a bottom view of the helmet 102.

Figure 5:
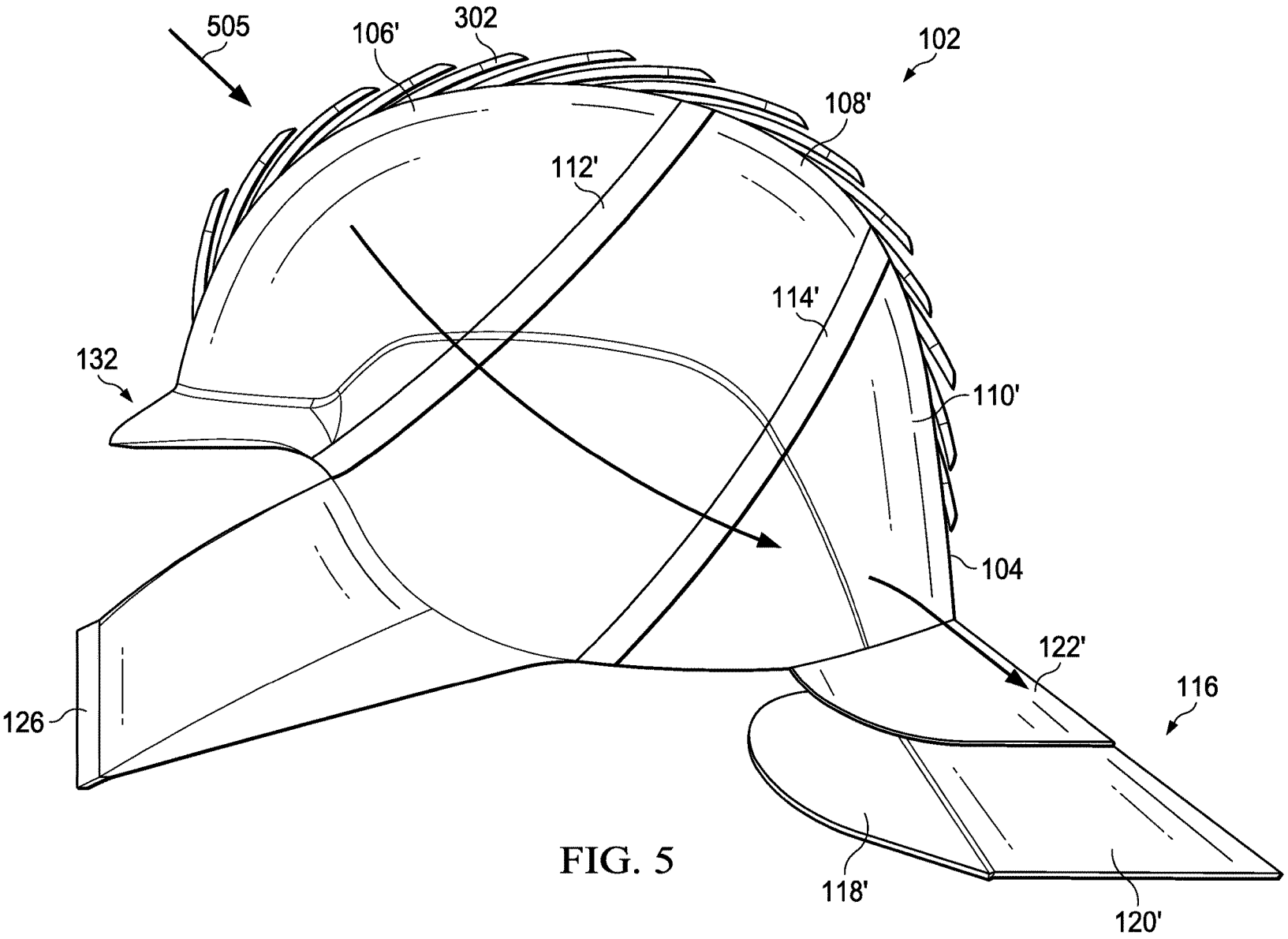
FIGS. 5 and 6 illustrate a side view of the assembled helmet showing a frontal impact.
Figure 6:
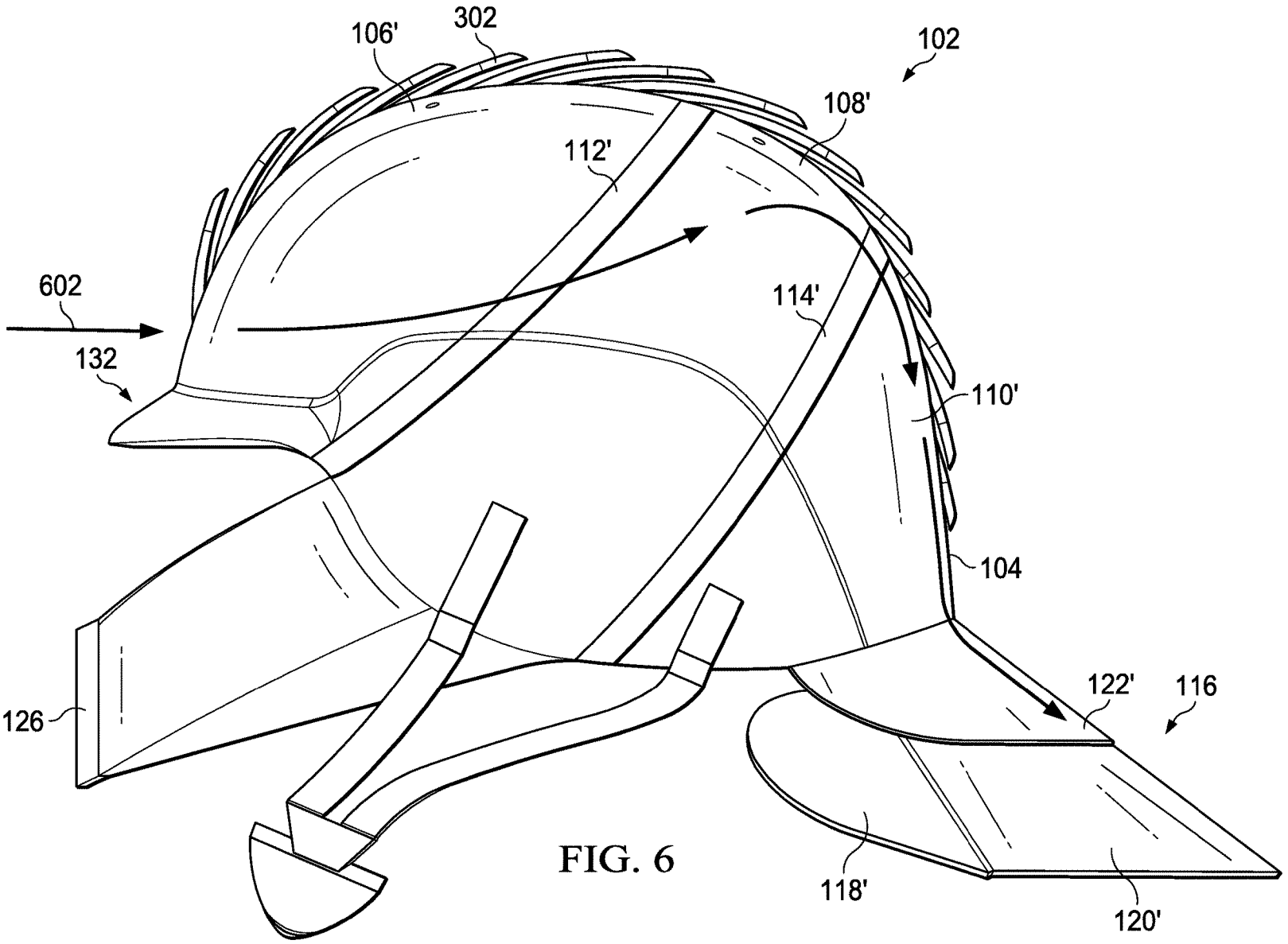

FIG. 5 illustrates a left side view of the helmet 102 illustrating one impact force. The impact is illustrated by arrow 505. This force is in the center portion of the sagittal portion 104 directly onto the plates 302. The force will impact the sagittal portion 104 and translate the force along the length of the sagittal portion to the lobster tail 116. The force will also move or be distributed laterally outward along the surface of the frontal panel 106' and then to the joiner 112' thereby compressing it. This force will then be transferred or distributed to the parietal panel 108' and then to the joiner 114' thereby compressing it. The force will then be transferred or distributed to the occipital panel 110' and then onto the lobster tail 116. Thus, it can be seen that the impact force is transferred from the front to the back of the helmet and around the cranium of the individual. FIG. 6 illustrates an additional such view showing how a force that is directed lower on the frontal panel 106' near the brow will be transferred across the various panels to the lobster tail 116.

Figure 7A:
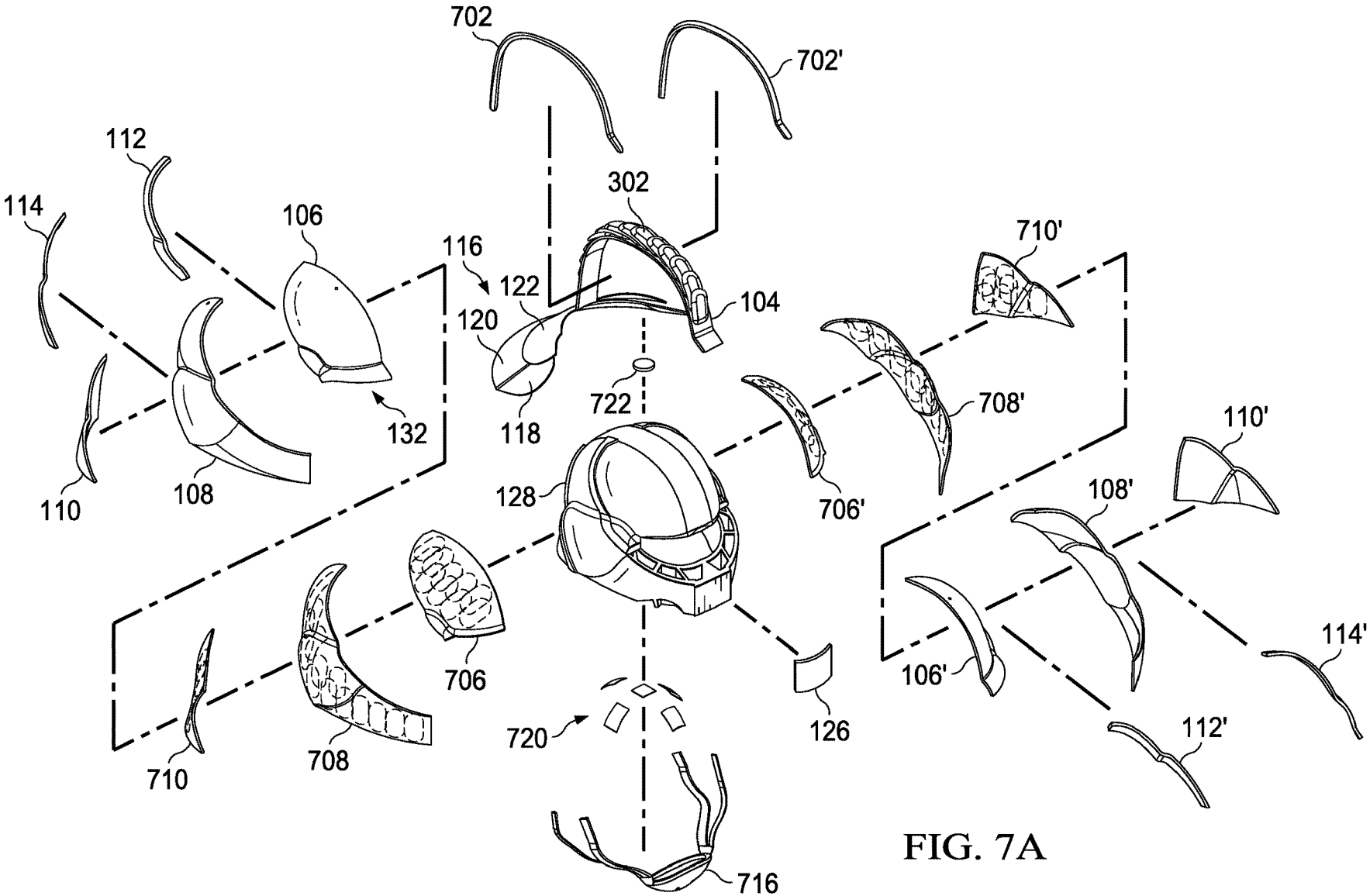
FIG. 7A illustrates an exploded view of the helmet.

FIG. 7A illustrates an exploded view of the helmet 102. For simplicity purposes, only the right side exploded view is illustrated, understanding that the left side exploded view is identical. In between the panels 106-110 largest posed pouches. These pouches contain compressed gas capsules, which really described hereinbelow. The panel 106 has associated there with a pouch 706 which conforms the shape of the panel 106, this being the frontal panel 106. The parietal panel 108 has associated there with a pouch 708 conforming to the shape thereof. The occipital panel 110 has a pouch 710 associated there with, conforming to the shape thereof.

Each of the pouches 706-710 is generally a fabric pouch that can contain one or more of the compressed gas capsules. Each of the pouches 706-710 has two surfaces that are connected together at the peripheral edges thereof to form an interior in which the compressed gas capsules are contained. These are replaceable pouches. As will be described in more detail hereinbelow, each of the compressed gas capsules will contain, in one exemplary embodiment, carbon dioxide. These compressed gas capsules are fabricated from a fracturable material such as ceramic. When they fracture, the carbon dioxide will then escape and lower the ambient temperature about the fractured capsule, thus cooling the surrounding area. If a number of the capsules are broken, this can provide immediate cooling to the cranium of the individual. Second embodiment of a chin strap 716 is illustrated, which is described hereinbelow. Additionally, it the sagittal portion 104 is joined to each of the panels 106-110 via a joiner 702 on the right side and a joiner 702' (not shown) on the left side.

Figure 7B:
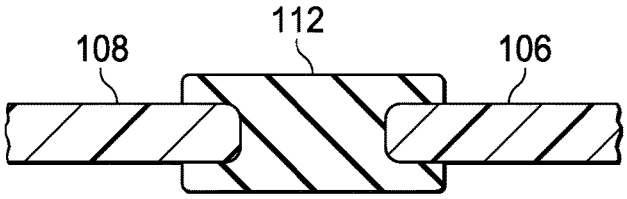
FIG. 7B illustrates a cross section of a joiner.

In general, when the helmet 102 is fully assembled, the pouches 706-708 will be disposed against the services of the inner helmet core 128. The outer panels 106-110 and their associated joiners 112 and 114 will then be attached. FIG. 7B illustrates joiner 112 for joining panels 106 and 108. In this embodiment, which is exemplary, the joiner 112 has an "H" shape and is made of an elastic material that, when the panels 106 and one away are inserted into the slots on either side thereof, will secure them together. Along with the joiner 702 that joins all three of the panels 106-110 to the sagittal portion 104, the entire assembly will be held together. Additionally, the joiner 126 will also have slots in the end thereof for joining the ends of the parietal panels 108 and 108' together.

Figure 8:
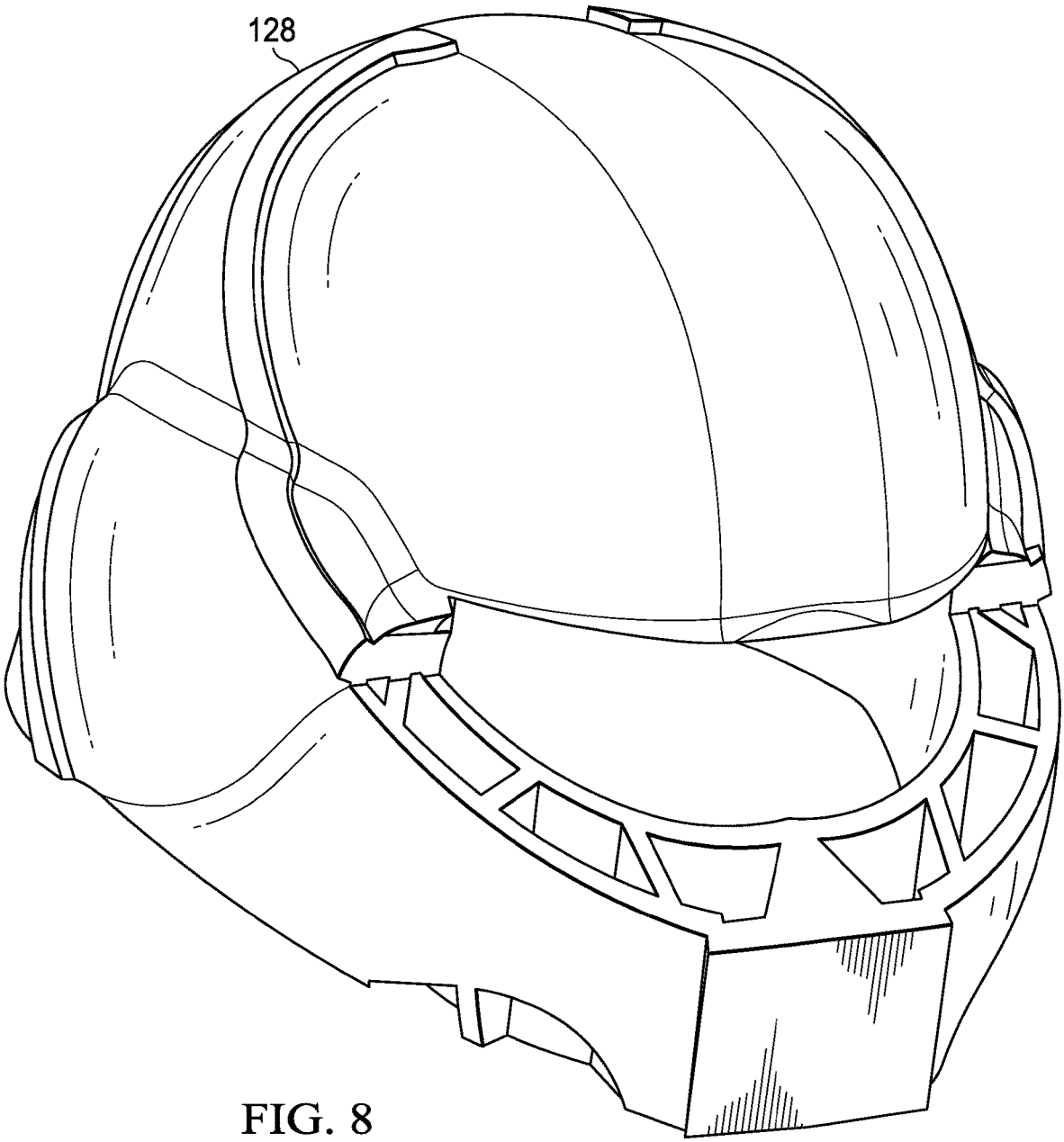
FIG. 8 illustrates a perspective view of the base foam layer.

Referring now to FIG. 8, there is illustrated a perspective view of the helmet core 128. This, as described above, can be formed of an open cell or closed cell foam that has a plurality of corrugated channels disposed therein. These are for the purpose of absorbing any impacts. This core 128 could be fabricated from any type of plastic or even fibrous material that provide the honeycombed structure that will absorb the impact. Additionally, the core 128 is designed to receive only inside thereof a plurality of sensors 720. A battery 722 (illustrated in FIG. 7A) is also provided on the upper surface thereof. The sensors 720 can be any type of sensors that can provide information guarding impacts. They can be in the form of four sensors, accelerometers which are associated with a microcontroller unit (MCU) for determining the status of the sensors. The battery 722 willpower the sensors. Upon receiving any impact which could, for example, be determined by an accelerometer, a force sensor can then measure the extent of the force and the location of the force and record this for later feedback.

Figure 9:
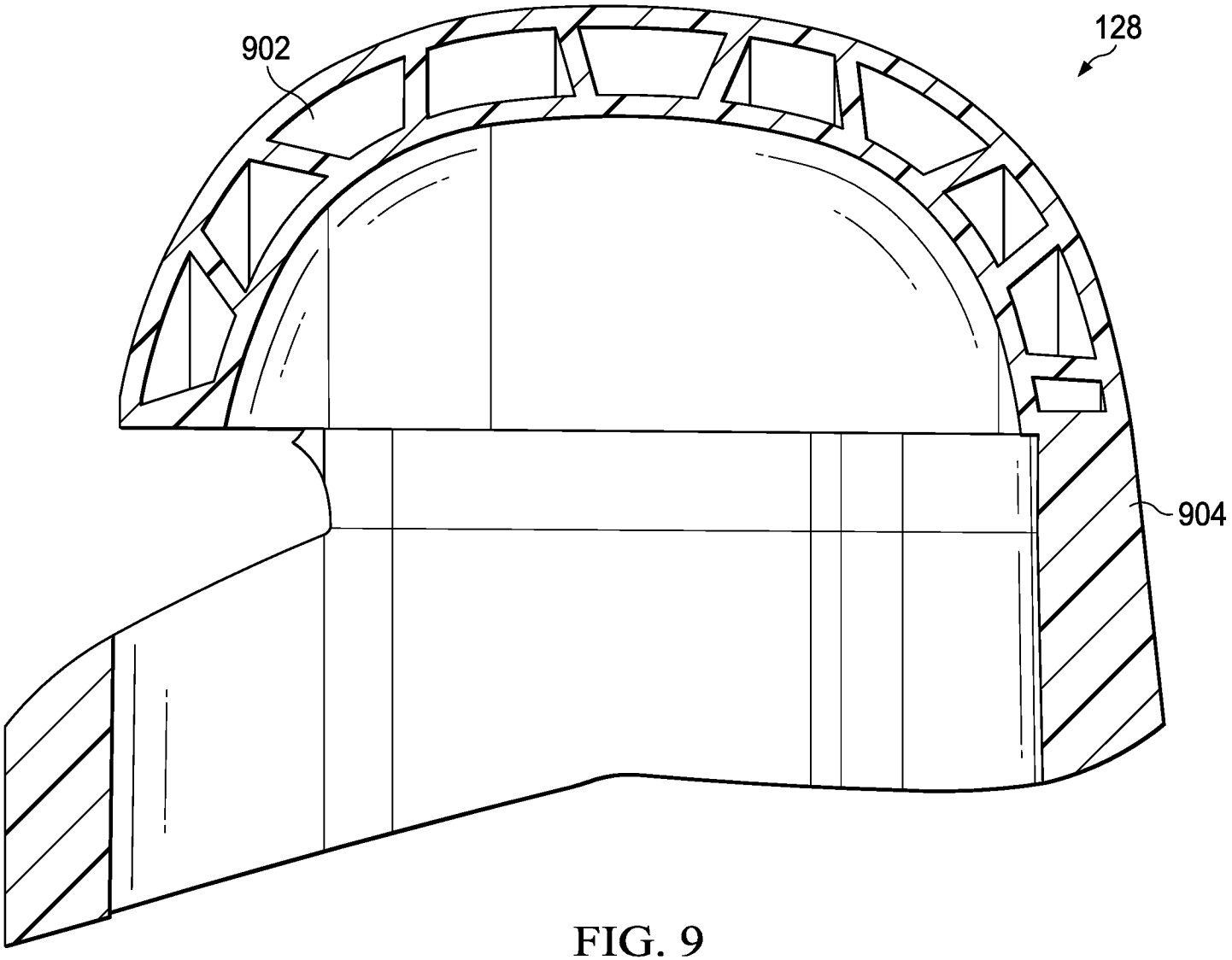
FIG. 9 illustrates a side in cross-section of the base foam layer.

For now to FIG. 9, there is illustrated a side view of the core 128 in cross-section. It can be seen that the honeycombed structure in the form of honeycombed cavities 902 extend around the upper cranial portion wherein the rear portion, a portion 904, could be solid.

Figure 10:
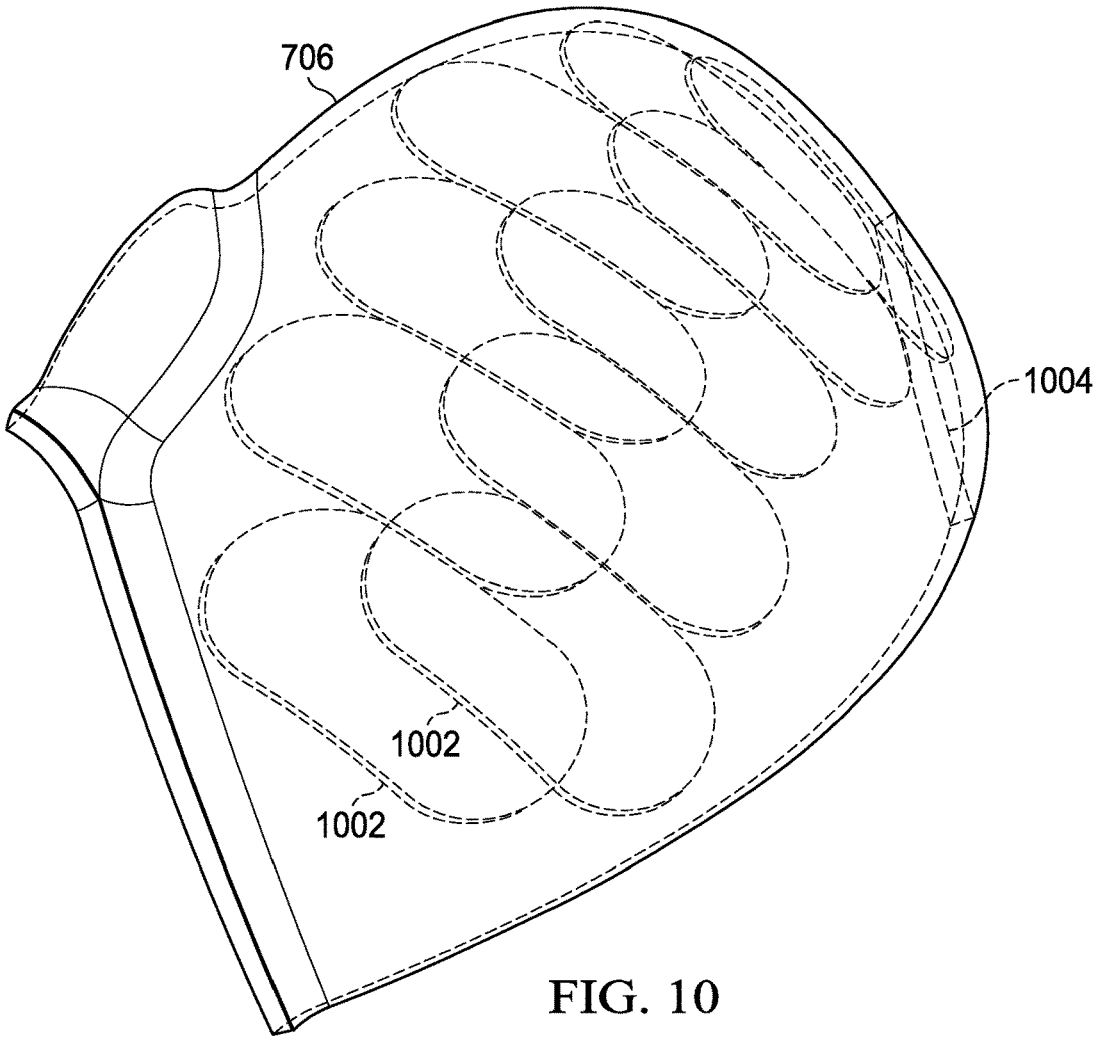
FIG. 10 illustrates a perspective view of one of the pouches with the compressed gas canisters contained therein.

Referring now to FIG. 10, there is illustrated a detail of one of the pouches, the frontal pouch 706. In the frontal pouch 706, there are disposed a plurality of compressed gas canisters 1002. These compressed gas canisters 1002 are disposed in an overlapping manner. These compressed cast canisters are fabricated from a ceramic material that is coated with silicon. The silicone material will aid in disposing the canisters 1002 within the pouch 706. As described hereinabove, the frontal pouch 706, and all the pouches 706-710, are fabricated from a fibrous material such as cloth. The coating on the compressed gas canisters 1002 will allow the canisters to be disposed in overlapping manner against the surface thereof without slipping or moving. If necessary, pockets could be provided within the frontal path 706 to maintain the compressed gas canisters 1002 in place. A strap 1004 is disposed on the pouch 706 to allow the pouch 706 to be retracted from its position within the helmet 102. Since the pouch 706 is a fibrous material, it can "breathe" in that it has no gas or liquid barrier associated there with. In such a manner, when any of the compressed gas canisters 1002 are "fractured," the gas will be released and expand outward and through the fibrous material of the pouch 706. This release of gas will provide a cooling effect to the surrounding area, which will be toward the surface of the helmet core 128 and provide some cooling to the cranial area proximate thereto. Typically, any type of impact will result in the fracture of multiple ones of the compressed gas canisters 1002. It should also be noted that the plastic structures 302 on the sagittal portion could the associated each with a compressed gas canister 1002.

Each of these gas canisters 1002 can be replaced with a "pouch" filled with some type of impact absorbing material such as gel or foam or any such material. They can be manufactured such that the pouch can rupture upon impact or just be resilient enough to expand and contract back to its original shape. It is not necessary to utilize gas canisters of. The gas canisters, as compared to a gel filled house, provide some cooling upon fracture and expansion of the gas. This would be an added benefit to the use of such pouches.

Figure 11:
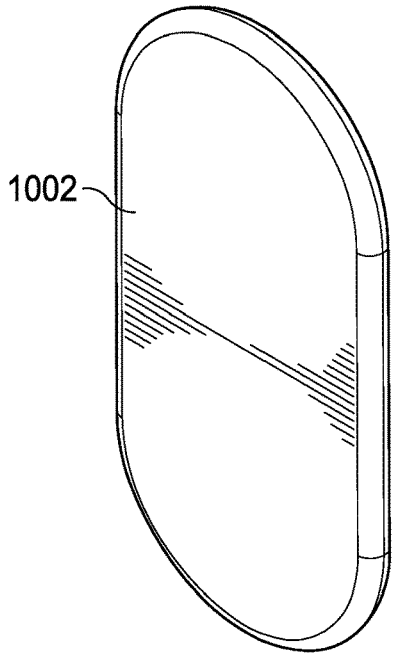
FIG. 11 illustrates a perspective view of one of the compressed gas canisters.

Free now to FIG. 11, there is illustrated a perspective view of one of the compressed gas canisters 1002. As described hereinabove, this compressed gas canister is a single unit that is fabricated from a ceramic material or any type of material that can fracture while providing a sealed enclosure. It could even be fabricated from a resilient rubberized material similar to a balloon with some type of surface structure that would allow the material to the "pierced" upon receiving an impact. In the case of a material that would fracture, this would just be a function of the amount of force applied thereto. In the embodiment with a resilient balloon like enclosure containing the gas, this would require compression of the associated outer one of the panels 106-110 to allow piercing. This piercing, course, is provided by, for example, a plate with small needle-like structures associated there with that, when associated with a compression, would rupture the balloon-like container.

Figure 12:
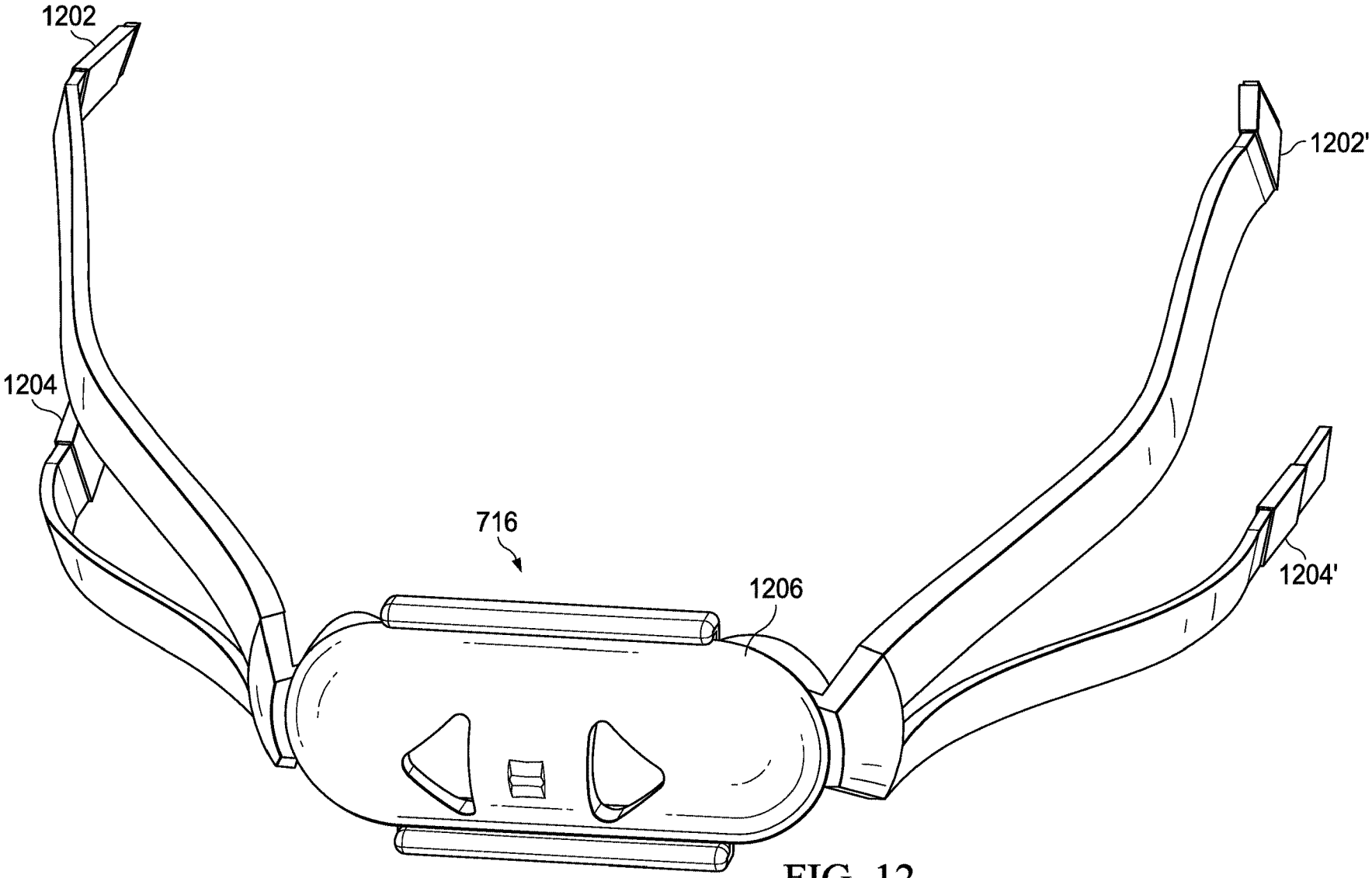
FIG. 12 illustrates a perspective view of the chin strap.

Referring now to FIG. 12, there is illustrated a perspective view of the chinstrap 716. This particular chinstrap 716 has two left side connectors 1202 and 1204 and two side connectors 1202' and 1204' a front chin portion 1206 is connected by the connectors 1202, 1204 number 1202' and 1204' to four section portion 1206 against the chin. Additionally, although not shown, the chin portion 1206 could contain one or more compressed gas canisters 1002 also.

Figure 13:
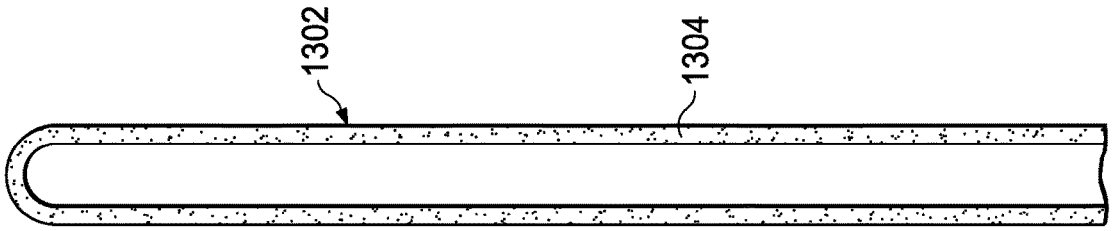
FIG. 13 illustrates a cross-sectional view of one of the compressed gas canisters.
Figure 15:
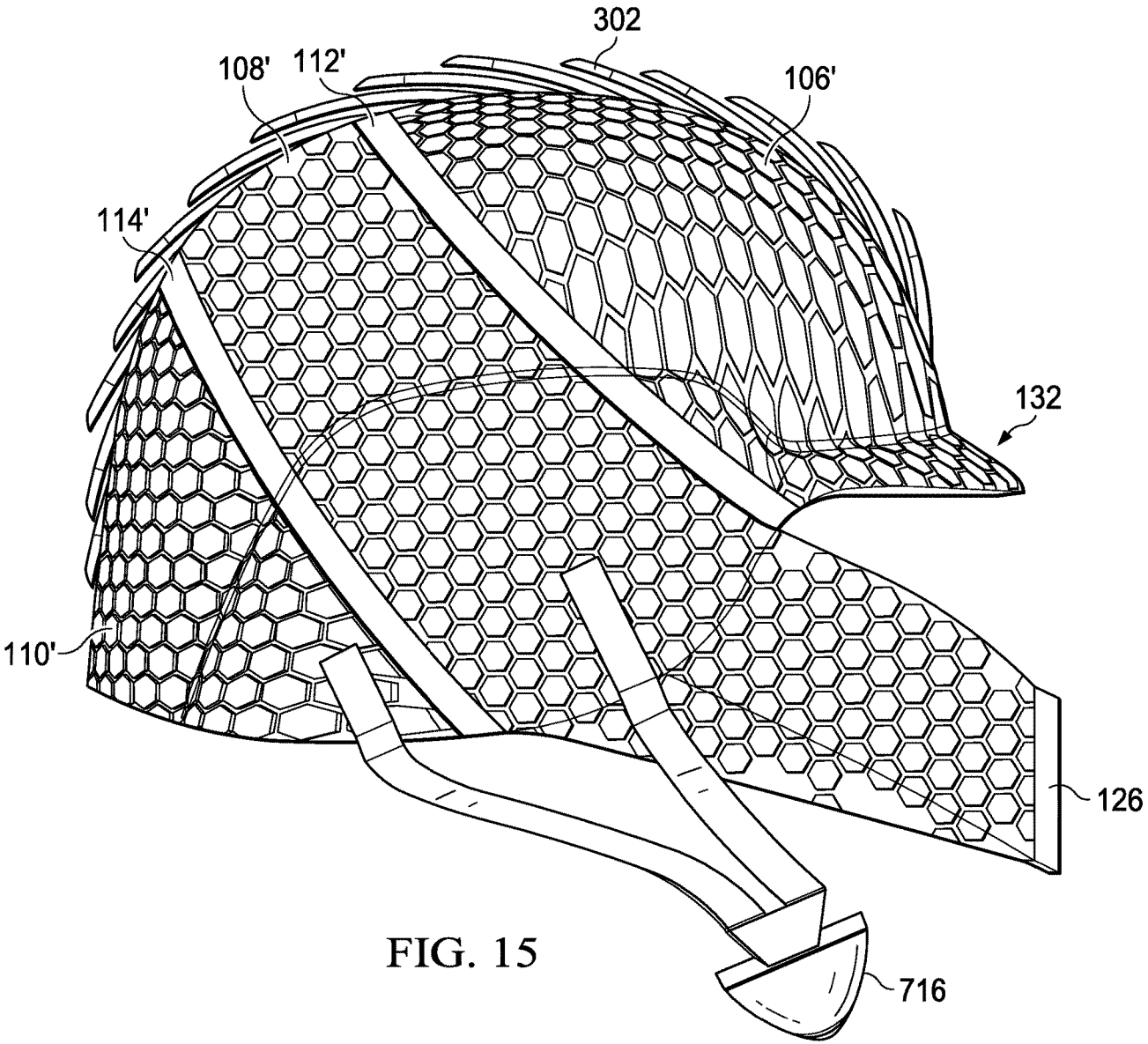
FIG. 15 illustrates a side view of an alternate embodiment for the helmet.
Figure 16:
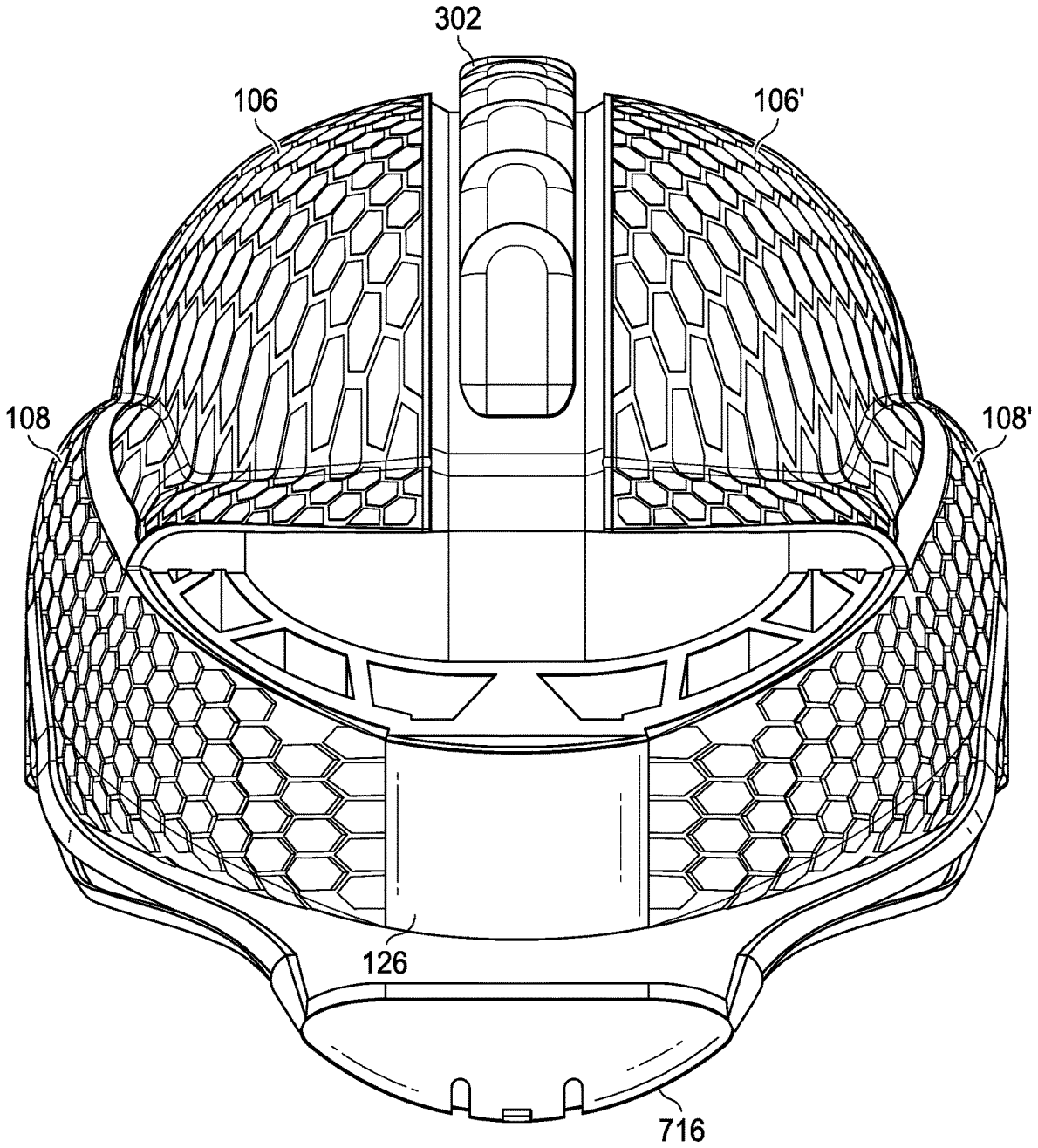
FIG. 16 illustrates a front view for the alternate embodiment for the helmet.
Figure 17:
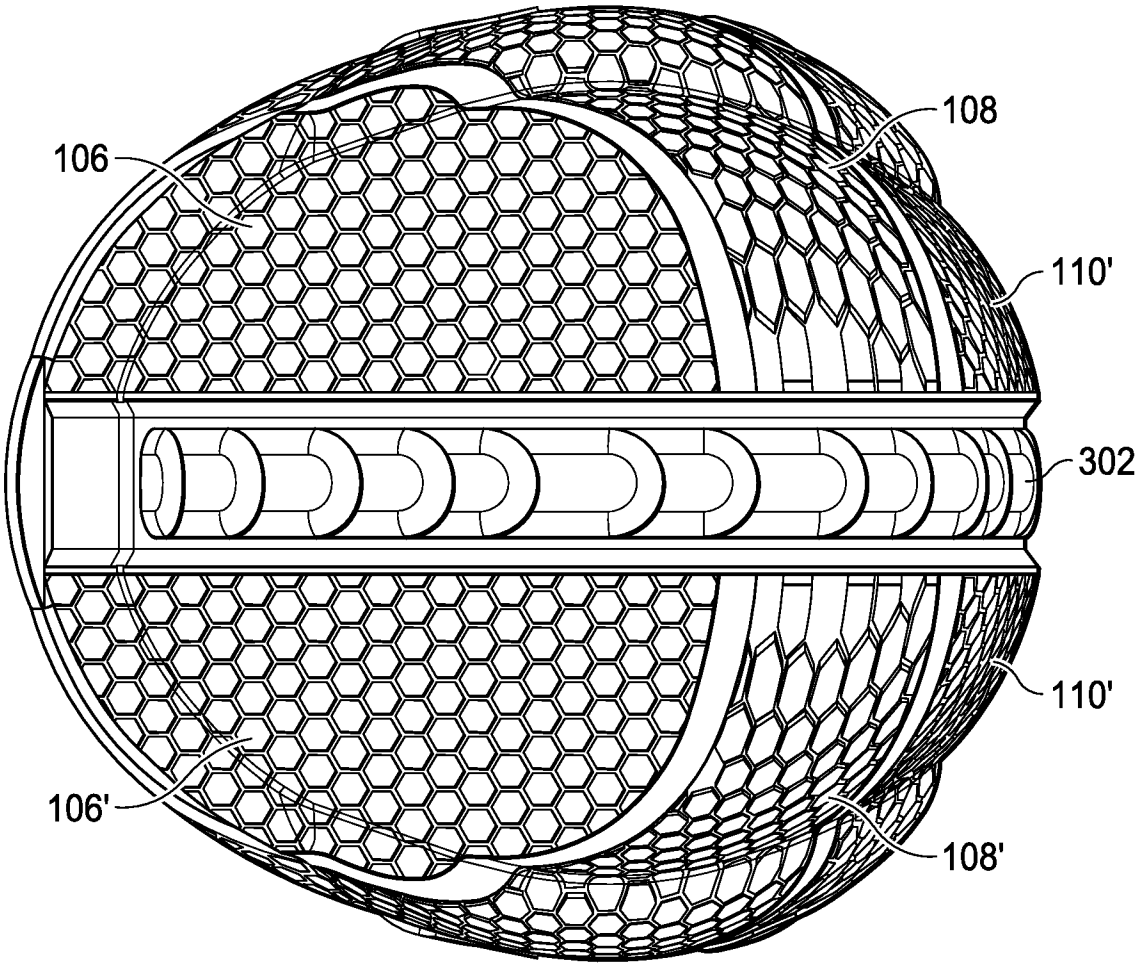
FIG. 17 illustrates a top view for the alternate embodiment for the helmet.
Figure 18:
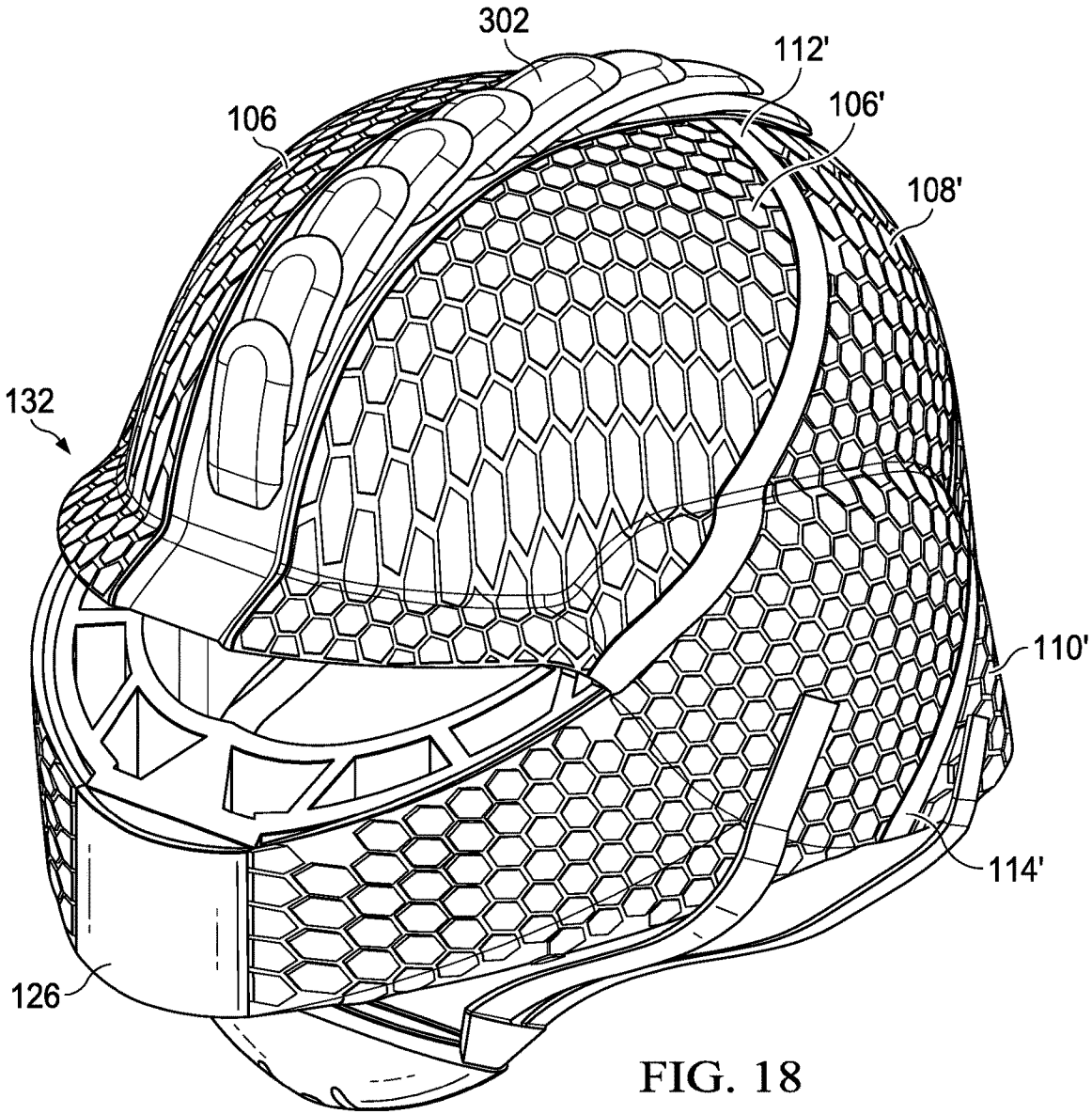
FIG. 18 illustrates a perspective view for the alternate embodiment for the helmet.

Referring now to FIG. 13, there is illustrated a cross-sectional view of a pouch 1302. This represents the pouches 706-710. The past 1302 is comprised of a material 1304 which is some type of fibrous material that can "breathe" in that it does not have a moisture or a gas barrier associated there with but can contain the compressed gas canisters 1002. As noted hereinabove, each of the compressed gas canisters will have some type of outer coding such as silicon that will allow the compressed gas canister 1002 to be disposed within the pouch 1302 in such a manner that it will not "slide" with respect to the surface thereof, such that the gas canisters 1002 can be disposed therein without moving about. As also noted hereinabove, additional sub pouches could be disposed within the pouch 1302 in order to hold the compressed gas canisters 1002 in place.

Figure 14:
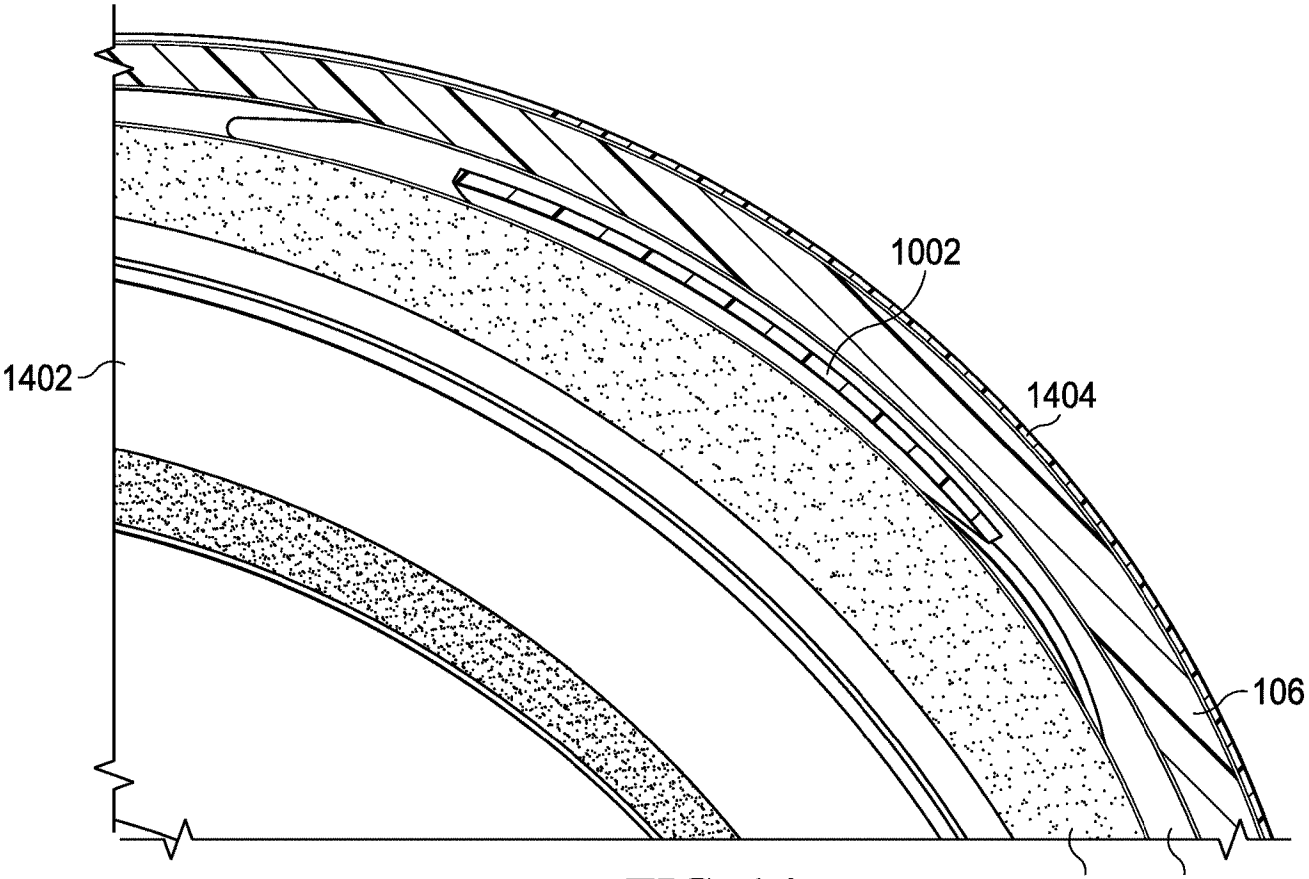
FIG. 14 illustrates a cross-sectional view of one section of the helmet illustrating the different layers.

Referring now to FIG. 14, there is illustrated a cross-sectional view of the helmet illustrating the front panel 106, the pouch 706 and the inner core 128. It can be seen that the pouch 706 has illustrated one compressed gas canister 1002 disposed therein. It can be seen that the inner core 128 will have foam disposed on opposite sides of a gap 1402, which corresponds to the corrugated openings 902 illustrated in FIG. 9. In addition, there is provided on the outer surface thereof a paint coating 1404. This paint coating 1404 is a commercially available product that is referred to by the tradename Dura Grip Oil-Based which is a skid resistant epoxy coating. This is manufactured by Slipdoctors. This contains toluene, xylene, clay, ethylbenzene, titanium dioxide, cobalt carboxylate, epoxy resin and methyl ethyl ketoximine. Additionally, one constituent comprises crystalline quartz silica. Planswift is another polyurethane paint spray marketed under the tradename Duayen MS-800.

The operation of the helmet 102, it can be seen that impacts that are received by the helmet are distributed in a number of manners. The first aspect of an impact is the paint 1404 which distributes the force. Thereafter, the panels 106-110 will absorb the force in addition to the sagittal portion 104. These panels 106-110 and sagittal portion 104 will distribute the force in the direction back towards the lobster tail 116 and the joiners 112 and 114 in addition to the joiners 702 will absorb a portion of this impact. Thus, the force is transmitted back to the lobster tail 116 initially.

The next line of force absorption is the compressed gas canisters 1002 that will fracture, which both absorbs force and releases the compressed gas in the form of the carbon dioxide that will provide a cooling effect.

The next line of force absorption will be the foam associated with the core 128. This will be both absorption to the actual foam material and also the corrugated structure thereof with the corrugated gaps 902.

Referring now to know 15-18, there are illustrated a side view, a front view, a top view and a perspective view, respectively, of an alternative embodiment of the helmet, wherein the outer panels 106, 108, 110, 106', 108' and 110' have a honeycombed structure disposed on the surface thereof or formed as an integral part thereof. These honeycomb structures can have different shapes. They can be hexagonal, Cardinal, circular, or any mixture of shapes. They resemble the surface structure of an integral such as an armadillo, which is surface structure provides an armor for the armadillo.

Figure 19:
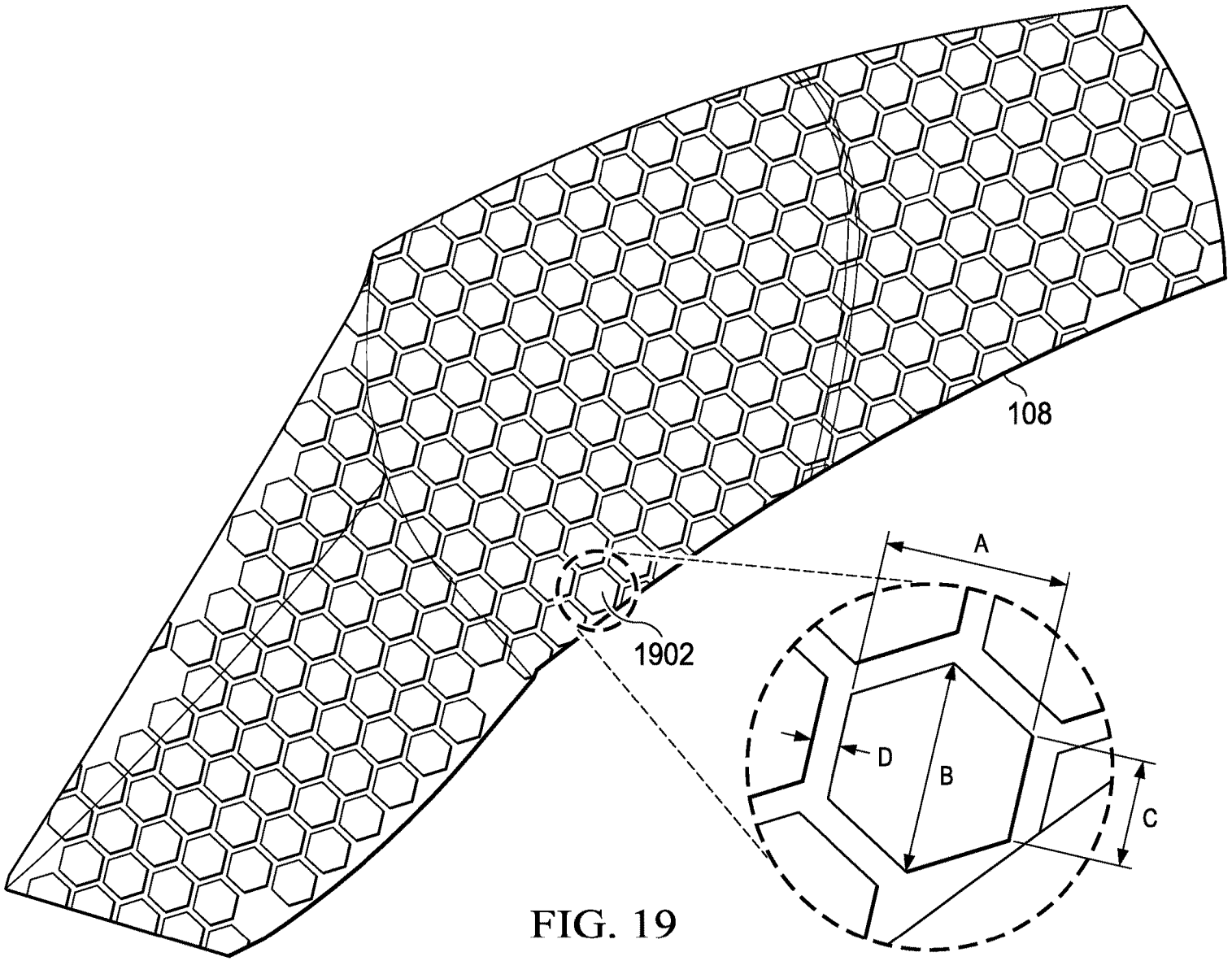
FIG. 19 illustrates one of the middle panel for the alternate embodiment for the helmet.

Referring now to FIG. 19, there is illustrated a side view of the panel 18 in one embodiment. This embodiment, the structure on the surface thereof is a honeycombed with a plurality, in one embodiment, of flexible flat structures 1902 raised from the surface thereof and separated from each other. With such a structure, there is provided a bio-mimicking armor construction. In detail, there is illustrated the dimensions, and one embodiment, of the hexagon structure in the honeycomb embodiment. This hexagon structure, in one embodiment, has a flat surface-to-flat surface dimension "A" of 9.28 mm, and apex-two apex dimension "B" of 10.29 mm, a surface dimension "C" of 5.08 mm and a separation dimension "D" between flat edges of adjacent raised structures of 1.35 mm. The height or depth of each hexagon is 5 mm. These dimensions are by way of example.

This bio-mimicking armor construction to be fabricated from such materials asCalves Leather, Fiberglass, Pyrex Glass, Gorilla Glass, Polyester Epoxies, Corrugated Cardboard, Stainless Steel (fibers, wires, weave, sheet), Titanium (fiber, grate, sheet, Aramid Kevlar ballistic, Kevlar 160, 540, 750 weave, carbon fiber, pulp Kevlar, sorbothane, alpha gel, silicone, hemp weave, carbid, graphene, alliance rubber bands, honey comb aluminum, steel, corrugated cork, honeycomb Aramid. This construction provides on the surface of each of the panels a skill configuration that provides anti-shock and elastic properties that, when subjected to an impact, will absorb such impact and transfer it to the various shells through the couplings 112 and 114. This allows the various panels 106, 108 and 110 to move relative to each other with the elastomer material for the such, as described above, that separates them to absorb the impact and allow movement.

Figure 20:
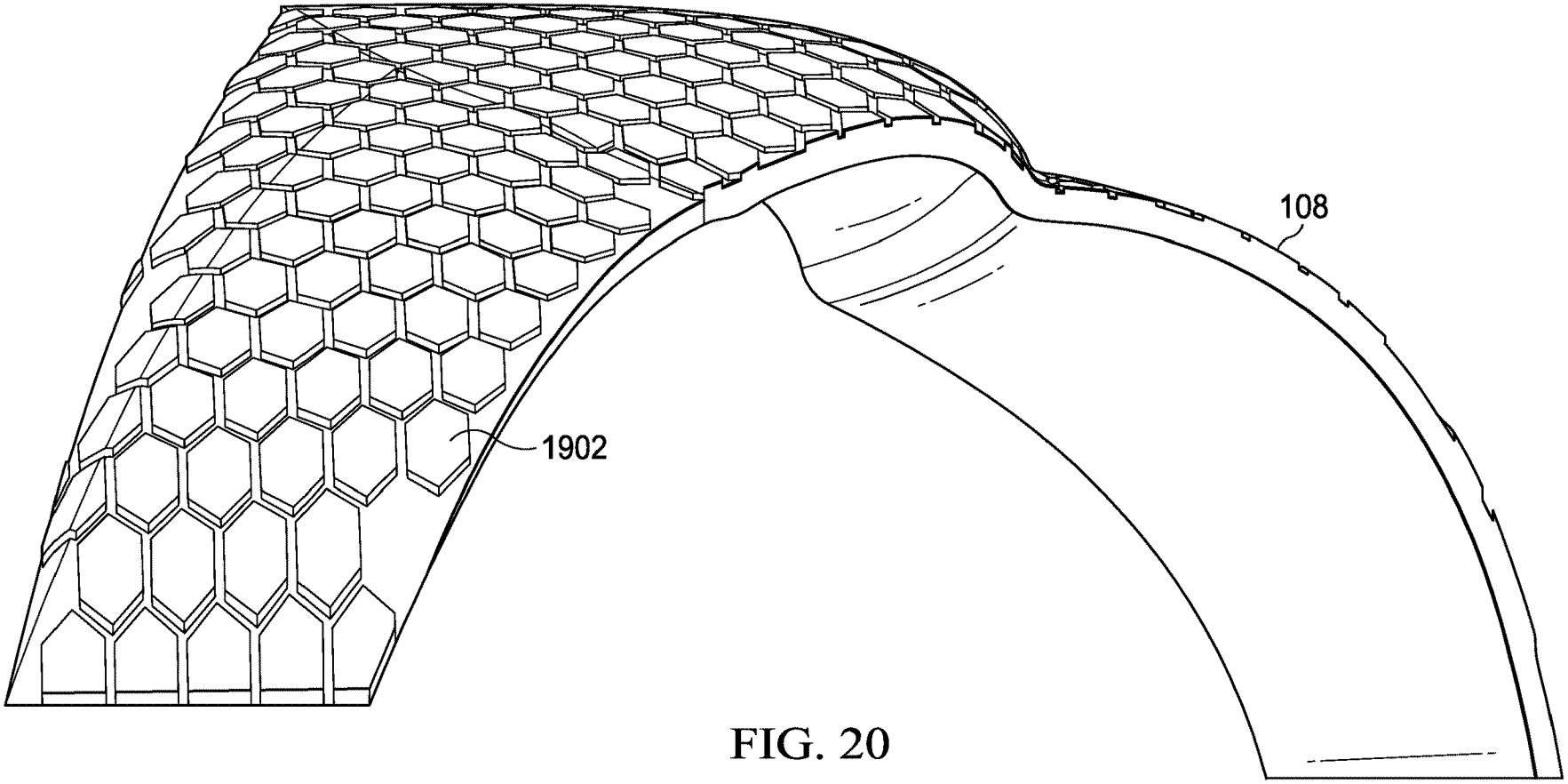
FIG. 20 illustrates a perspective view for the middle panel of FIG. 19.
Figure 21:
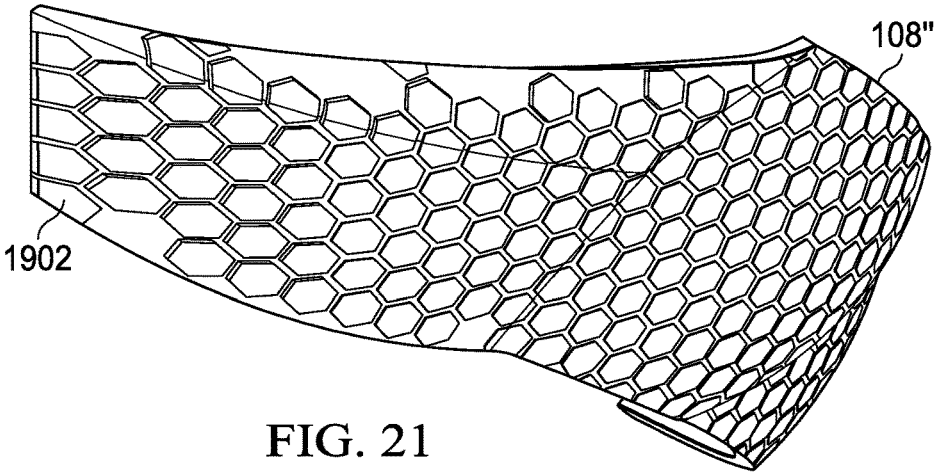
FIGS. 21 and 22 illustrate alternate views for the middle panel of FIG. 19.
Figure 22:
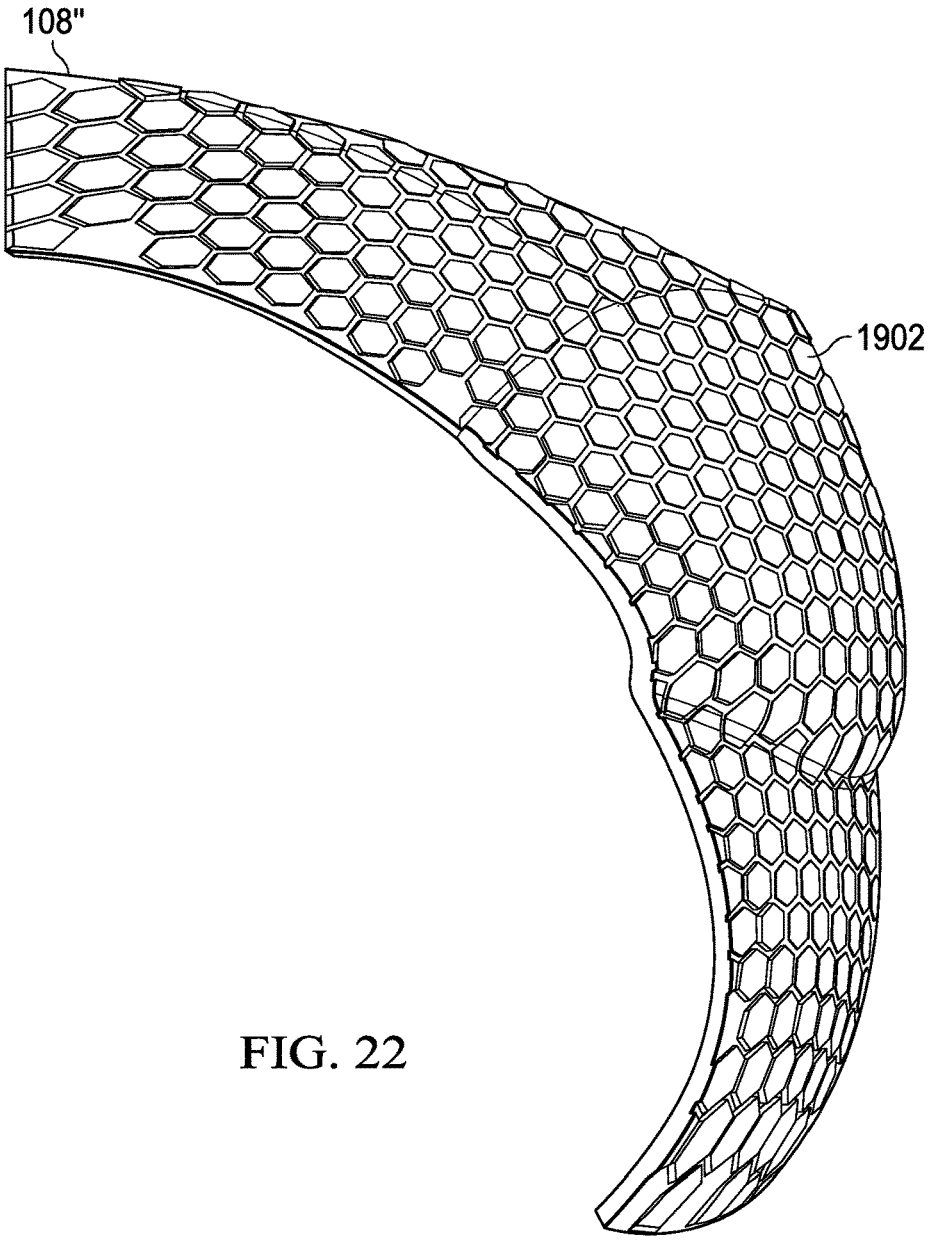
Figure 23A:
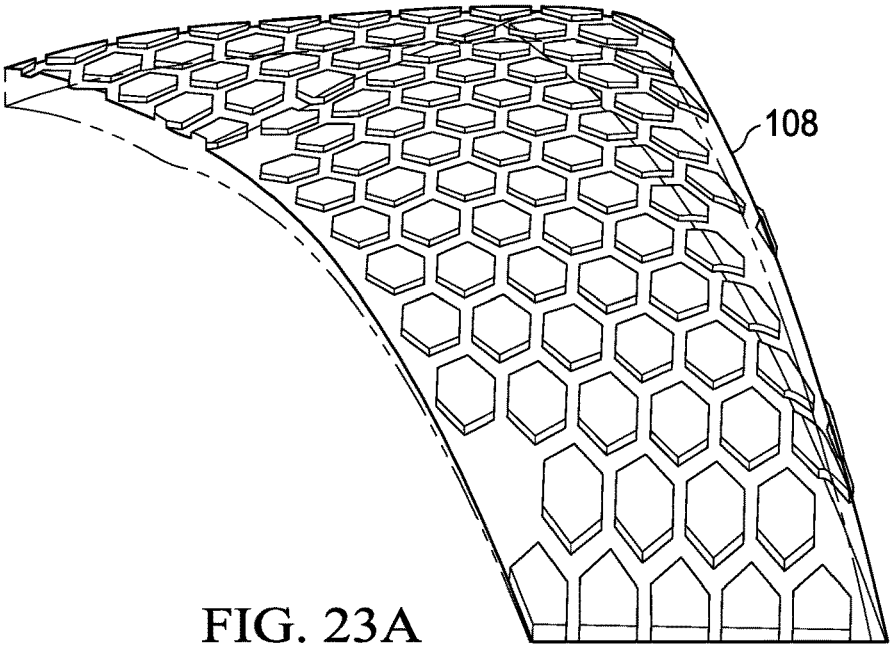
FIGS. 23A and 23B illustrate an alternate embodiment for the middle panel with a thin skin.
Figure 23B:
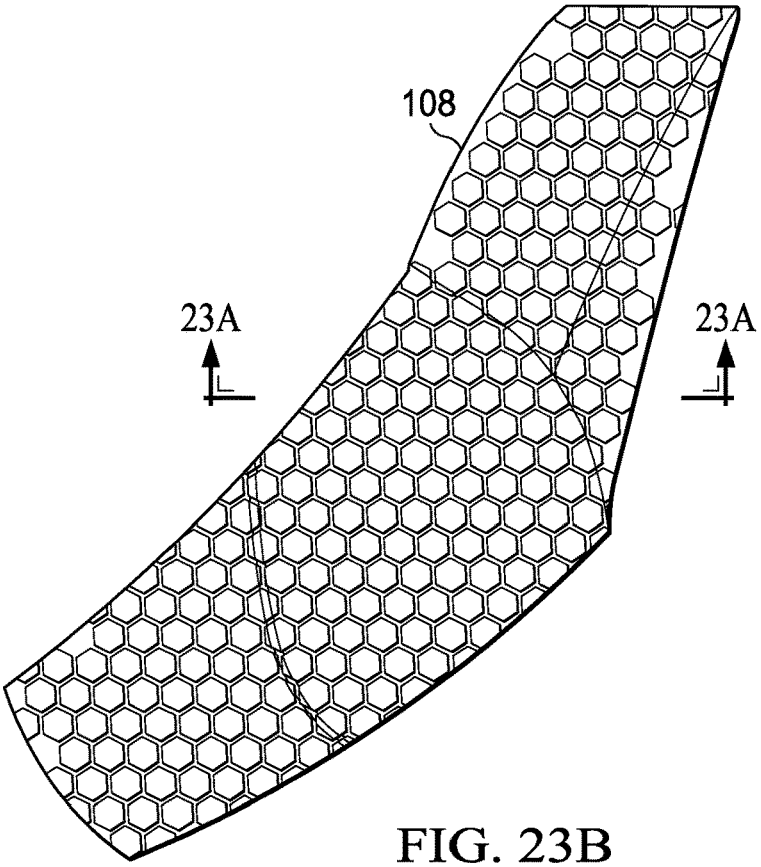
Figure 24A:
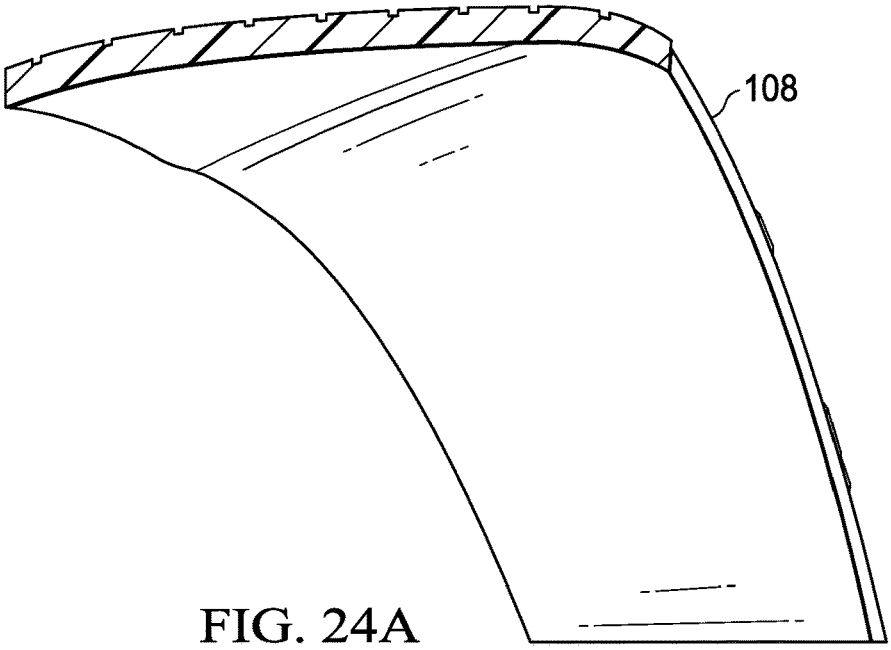
FIGS. 24A and 24B illustrate an alternate embodiment for the outer surface of the panel utilizing a thicker skin.
Figure 24B:
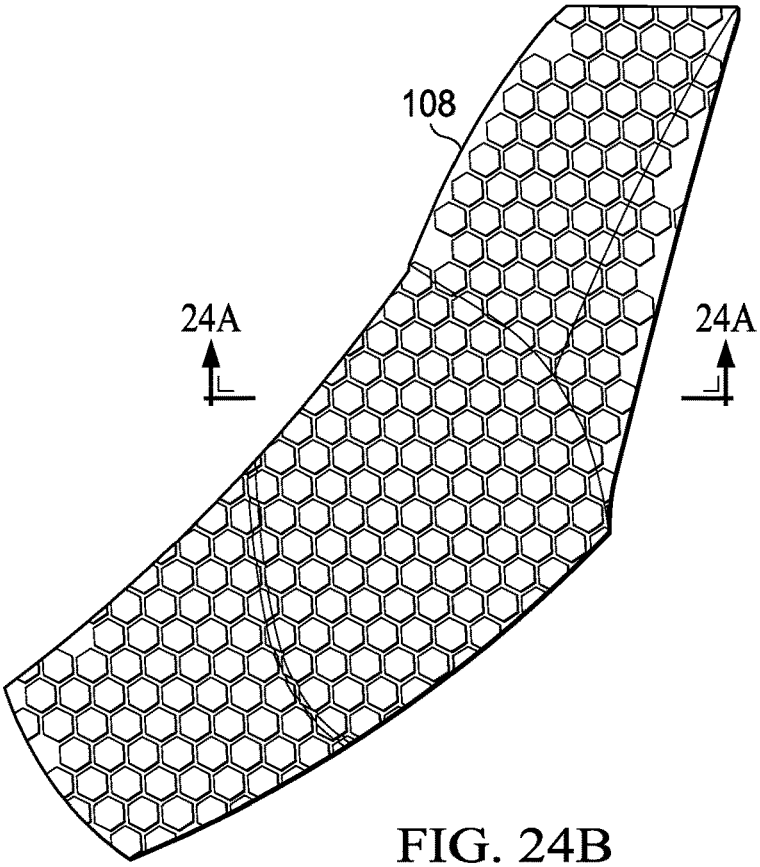

Referring now to FIG. 20, there is illustrated a perspective view of the panel 108. In this embodiment, it can be seen that the entire panel is fabricated from the same material such that the raised structures 1902 that provide the bio-mimicking performance is formed with an integrated panel. In the embodiments of FIGS. 21 and 22, there is illustrated a skin 108" that is comprised of a plurality of the raised structures 1902 (a hexagonal shape in this embodiment). This skin is operable to be attached to the panels 108 and 108'. Similar skins will be attached to the panels 106, 110, 106', and 110'. The skins, as described hereinabove, can be of the same material as the panels 106, 108, 110, 106', 108' and 110', or can be of a different material. The whole purpose of these raised structures 1902 is to provide the bio-mimicking performance that can be seen on the skin of such animals as armadillos.

It will be appreciated by those skilled in the art having the benefit of this disclosure that this force distribution helmet provides a flexible helmet assembly that distributes forces about the cranium of an individual in order to protect the individual's brain. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An impact resistance spreading helmet, comprising:

a frontal section configured to interface with the forehead of an individual and extend upward over the cranium;

a medial section for extending over a portion of the cranium rearward of the frontal section;

an occipital section for extending rearward from the medial section and configured to cover a portion of the neck of the individual;

a first compressible structure disposed between the frontal section and the medial section; and a second compressible structure disposed between the medial section and the occipital section;

wherein:

the interface between the frontal section and the first compressible structure is disposed at an angle vertical to a force direction perpendicular to the frontal section above the forehead of the individual, and the first and second compressible structures are elastomeric materials.

2. An impact resistance spreading helmet, comprising:

a frontal section configured to interface with the forehead of an individual and extend upward over the cranium;

a medial section for extending over a portion of the cranium rearward of the frontal section;

an occipital section for extending rearward from the medial section and configured to cover a portion of the neck of the individual;

a first compressible structure disposed between the frontal section and the medial section; and a second compressible structure disposed between the medial section and the occipital section;

wherein:

the interface between the frontal section and the first compressible structure is disposed at an angle vertical to a force direction perpendicular to the frontal section above the forehead of the individual, and each of the frontal section, medial section and occipital section are divided along the sagittal line of the cranium of the individual such that each of the frontal section, medial section and occipital section are divided into respective left and right frontal sections, medial sections and occipital sections and further comprising a sagittal compressible structure disposed between and joining each of the respective left and right frontal sections, medial section and occipital sections in the first and second compressible structures comprised of respective left and right first compressible structures and second compressible structures for interfacing with the sagittal compressible structure.

3. The helmet of claim 1, and further comprising a plurality of breakable discs disposed in proximity to each of the frontal section, medial section and occipital section, each of the plurality of breakable discs having a hollow space containing a compressible gas within the interior thereof, such that each of the plurality of breakable discs will break and release the gas contained therein upon a force above a certain threshold being applied to any of the plurality of breakable discs to absorb force.

4. The helmet of claim 3, wherein each of the breakable discs has contained in the hollow space therein carbon dioxide which, upon release, will provide a lower temperature in the area about the breakable disc.

5. The helmet of claim 3, and further comprising a plurality of liners, each for containing a plurality of the breakable discs and each of the plurality of liners associated with each of the frontal, medial and occipital sections and connected thereto.

6. The helmet of claim 1, and further comprising an interior helmet shaped liner fabricated from a honeycomb material which provides a base for mounting of the frontal, medial and occipital sections thereto in association with the first and second compressible structures.

7. The helmet of claim 6, and further comprising sensors disposed proximate to the interior helmet shaped liner for sensing forces applied to the helmet.

8. An impact resistance spreading helmet, comprising:

a base helmet liner for conforming to the cranial shape of an individual and having a honeycomb structure for absorbing forces;

a frontal section comprised of left and right frontal sections and configured to interface with the forehead of an individual and extend upward over the cranium;

a medial section comprised of left and right medial sections and configured to extend over a portion of the cranium rearward of the left and right frontal sections;

an occipital section comprised of left and right occipital sections and configured to extend rearward from the left and right medial sections and configured to cover a portion of the neck of the individual;

a first compressible structure comprised of left and right first compressible structures disposed between respective ones of the left and right frontal sections and the left and right medial sections;

a second compressible structure comprised of left and right second compressible structures and disposed between the respective ones of the left and right medial sections and the left and right occipital sections; and a sagittal compressible structure extending from the foremost edge of the frontal section to the rearmost edge of the occipital section and operable to join all of the left and right frontal sections, medial sections, and occipital sections, first compressible structures and second compressible structures;

wherein:

the interface between the frontal section and the first compressible structure is disposed at an angle vertical to a force direction perpendicular to the frontal section above the forehead of the individual.

9. The helmet of claim 8, wherein the first and second compressible structures and the sagittal compressible structure are elastomeric materials.

10. The helmet of claim 8, and further comprising a plurality of discs disposed in proximity to each of the respective left and right frontal sections, left and right medial sections and left and right occipital sections, each of the plurality of breakable discs having a hollow space containing a compressible gas within the interior thereof, such that each of the plurality of breakable discs will break and release the gas contained therein upon a force above a certain threshold being applied to any of the plurality of breakable discs to absorb force.

11. The helmet of claim 10, wherein each of the breakable discs has contained in the hollow space therein carbon dioxide which, upon release, will provide a lower temperature in the area about the breakable disc.

12. The helmet of claim 10, and further comprising a plurality of liners, each for containing a plurality of the breakable discs and each of the plurality of liners associated with each of the left and right frontal, left and right medial and left and right occipital sections and connected thereto.

13. The helmet of claim 8, and further comprising a plurality of sensors disposed within the helmet liner for sensing force.

14. The helmet of claim 8, wherein the helmet liner is comprised of polymeric material with honeycomb space disposed therein which are compressible to absorb force.

15. The helmet of claim 8, and further comprising an additional mouthpiece section comprised of left and right mouthpiece sections, each interfacing with and extending from an outermost edge of a respective one of the left and right medial sections, the left and right mouthpiece compressible sections for being disposed between the respective one of the left and right medial sections and the left and right mouthpiece sections.

* * * * *